US011403904B2

(12) United States Patent
Onishi et al.

(10) Patent No.: US 11,403,904 B2
(45) Date of Patent: Aug. 2, 2022

(54) COIN HANDLING APPARATUS

(71) Applicant: GLORY LTD., Himeji (JP)

(72) Inventors: Shuji Onishi, Himeji (JP); Hidekazu Tanaka, Himeji (JP)

(73) Assignee: GLORY LTD., Hyogo (JP)

( * ) Notice: Subject to any disclaimer, the term of this patent is extended or adjusted under 35 U.S.C. 154(b) by 38 days.

(21) Appl. No.: 16/865,552

(22) Filed: May 4, 2020

(65) Prior Publication Data

US 2020/0372745 A1 Nov. 26, 2020

(30) Foreign Application Priority Data

May 20, 2019 (JP) ..... JP2019-094537

(51) Int. Cl.

| | |
|---|---|
| ***G07D 9/00*** | (2006.01) |
| ***G07D 3/14*** | (2006.01) |
| ***G07D 9/06*** | (2006.01) |
| ***G07F 9/06*** | (2006.01) |

(52) U.S. Cl.
CPC ..... *G07D 9/008* (2013.01); *G07D 3/14* (2013.01); *G07D 9/06* (2013.01); *G07F 9/06* (2013.01)

(58) Field of Classification Search
CPC . G07D 9/008; G07D 3/14; G07D 9/06; G07F 9/06
See application file for complete search history.

(56) References Cited

U.S. PATENT DOCUMENTS 6,637,576 B1 * 10/2003 Jones ..... G07F 19/20 194/216
8,733,634 B1 * 5/2014 Eastman ..... G07F 19/201 902/8
2009/0166227 A1 * 7/2009 Imai ..... G07D 1/02 206/0.81
2009/0229950 A1 * 9/2009 Nakamoto ..... G07D 9/008 194/302

(Continued)

FOREIGN PATENT DOCUMENTS

EP 2259236 A2 12/2010
EP 2259236 A3 4/2011

(Continued)

OTHER PUBLICATIONS

English translation of KR-20160049633.*

(Continued)

*Primary Examiner* — Thien M Le
*Assistant Examiner* — Asifa Habib
(74) *Attorney, Agent, or Firm* — Renner, Kenner, Greive, Bobak, Taylor & Weber

(57) ABSTRACT

A coin handling apparatus includes: a first transport path configured to transport coins; a feeding unit configured to feed out the coins one by one to the first transport path; a recognition unit configured to recognize the coins fed out to the first transport path by the feeding unit; a storage unit arranged beneath the recognition unit, the storage unit being configured to receive the coins recognized by the recognition unit from the first transport path, and store the coins therein; and a cassette detachably mounted to the coin handling apparatus and arranged beneath the recognition unit and above the storage unit, the cassette being configured to receive the coins from the first transport path and store the coins therein.

13 Claims, 12 Drawing Sheets

(56) References Cited

U.S. PATENT DOCUMENTS

| | | | | |
|---|---|---|---|---|
| 2011/0039487 | A1 | 2/2011 | Nishida et al. | |
| 2014/0060997 | A1* | 3/2014 | Doi | G07F 9/08 194/206 |
| 2015/0228140 | A1* | 8/2015 | Martin | G07D 3/16 453/3 |
| 2015/0243119 | A1* | 8/2015 | Hayashi | G07D 11/14 194/206 |
| 2019/0147683 | A1 | 5/2019 | Kobayashi et al. | |
| 2021/0366244 | A1* | 11/2021 | Denny | G07F 19/201 |

FOREIGN PATENT DOCUMENTS

| | | | | |
|---|---|---|---|---|
| JP | 2012-174039 | A | | 9/2012 |
| JP | 5274549 | B | | 8/2013 |
| KR | 10-1165517 | B1 | | 3/2011 |
| KR | 20110023712 | A | * | 3/2011 |
| KR | 20160049633 | A | * | 5/2016 |

OTHER PUBLICATIONS

English translation of KR-20110023712.*
Extended European Search Report for Application No. 20173206.2-1009 dated Oct. 1, 2020.

* cited by examiner

COIN HANDLING APPARATUS

TECHNICAL FIELD

Field of the Invention

The present invention relates to a coin handling apparatus which handles coins.

Background of Invention

Conventionally, coin handling apparatuses that perform depositing and dispensing of coins have been used. A coin depositing/dispensing machine disclosed in Japanese Laid-Open Patent Publication No. 2012-174039 includes a plurality of storage/feeding units, each storing deposited coins therein and feeding out coins to be dispensed.

A recognition unit for recognizing coins is disposed above the plurality of storage/feeding units. In depositing, coins to be deposited are recognized one by one by the recognition unit. The recognized coins are transported along a transport path. The transport path is provided with chutes corresponding to the respective storage/feeding units. The coins recognized by the recognition unit are dropped through the corresponding chutes, based on the recognition results. Thus, the coins are stored in the plurality of storage/feeding units for each denomination.

A collection box detachable from the coin depositing/dispensing machine is disposed beneath the plurality of storage/feeding units. When collecting coins from the storage/feeding units, the coins to be collected are fed out and dropped from the storage/feeding units. The dropped coins are stored in the collection box. The collection box is removed from the coin depositing/dispensing machine, and it allows the coins to be collected together with the collection box.

A coin depositing/dispensing machine disclosed in Japanese Patent No. 5274549 also uses the own weight of coins to drop and transfer the coins. In depositing, a recognition unit disposed above a storage/feeding unit for storing coins therein recognizes coins. The recognized coins are dropped from chutes connected to a transport path and dropped coins are stored in the storage/feeding unit. When collecting coins, coins fed out from the storage/feeding unit are dropped and stored into a coin cassette disposed beneath the storage/feeding unit. The coin cassette is removed from the coin depositing/dispensing machine, and it allows the coins to be collected together with the cassette. Since the own weight of coins is used to drop and transfer the coins in the machine, the structure of the machine can be simplified as compared to the case where transport paths are used all the time for transferring coins.

SUMMARY OF THE INVENTION

In the conventional art, however, workability of coin handling using a cassette is poor. For example, when collection of coins is performed using a cassette detachably mounted to a coin handling apparatus, since the cassette is disposed at the bottom of the apparatus, the cassette cannot be easily mounted/dismounted. Meanwhile, when a storage unit inside the apparatus is replenished with coins by using the cassette, a dedicated transport path for replenishment needs to be provided for transporting coins fed out from the cassette.

The present invention is made to solve the problems of the conventional art, and an object of the present invention is to provide a coin handling apparatus that facilitates mounting/dismounting of a cassette.

A coin handling apparatus according to one aspect of the present invention, includes: a first transport path along which coins are transported; a feeding unit configured to feed out coins one by one to the first transport path; a recognition unit configured to recognize the coins that have been fed out to the first transport path by the feeding unit; a storage unit arranged beneath the recognition unit, the storage unit being configured to receive the coins, which have been recognized by the recognition unit, from the first transport path, and store the coins therein; and a cassette detachably mounted to the coin handling apparatus and arranged beneath the recognition unit and above the storage unit, the cassette being configured to receive the coins from the first transport path and store the coins therein.

The cassette detachably mounted to the coin handling apparatus is located above the storage unit for storing coins in the coin handling apparatus. Since the cassette is located at a higher position than in the conventional apparatus, the cassette can be easily mounted/dismounted.

The above and other objects, features, advantages and technical and industrial significance of this invention will be better understood by reading the following detailed description of presently preferred embodiments of the invention, when considered in connection with the accompanying drawings.

DESCRIPTION OF THE PREFERRED EMBODIMENTS

Figure 1:
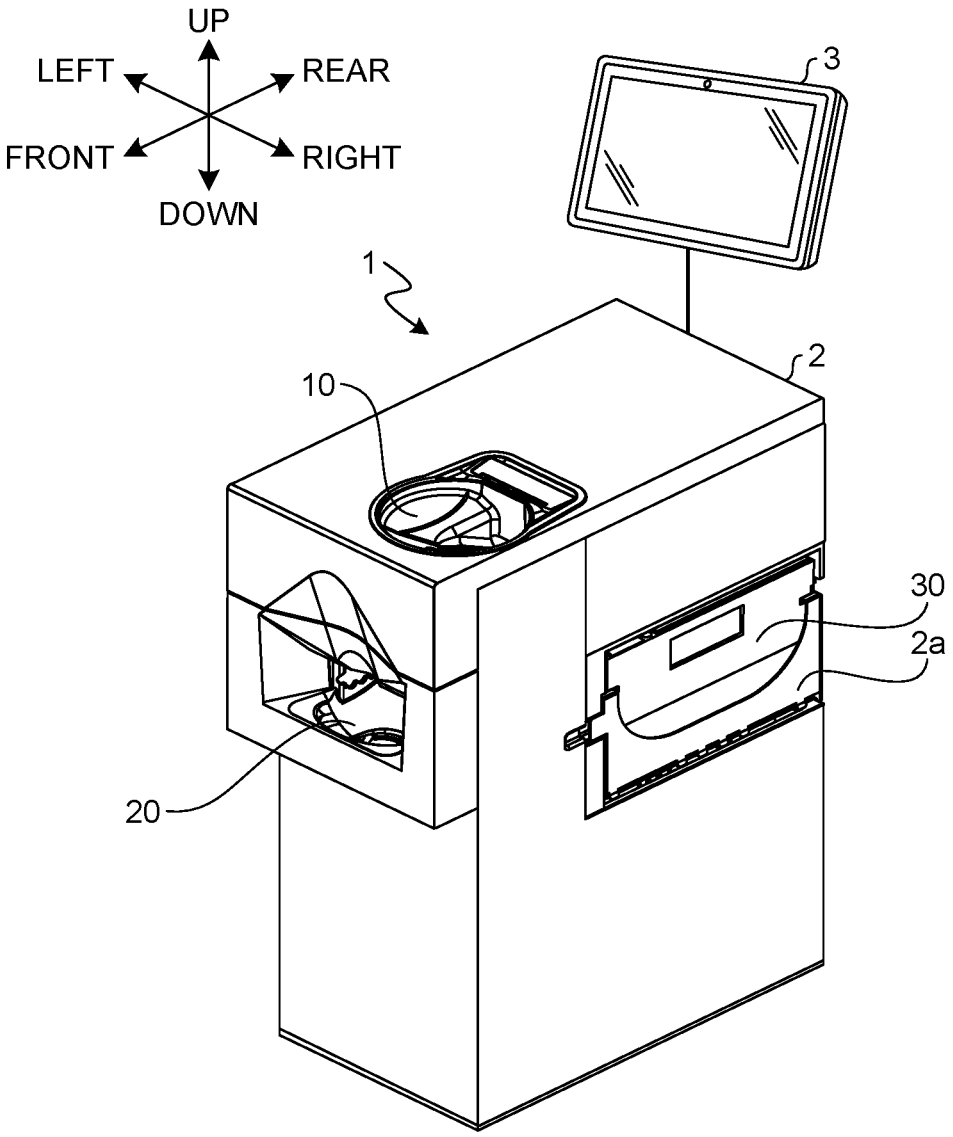
FIG. 1 is an external view of a coin handling apparatus according to an embodiment.

Hereinafter, an embodiment of a coin handling apparatus according to the present invention will be described with reference to the drawings. FIG. 1 is an external view of a coin handling apparatus 1 according to the present embodiment. As shown in FIG. 1, the coin handling apparatus 1 includes a coin handling unit 2 and an operation/display unit 3.

The coin handling unit 2 includes a depositing unit 10 for depositing coins, and a dispensing unit 20 for dispensing coins. In FIG. 1, the dispensing unit 20 is disposed on a front surface of the coin handling unit 2. The depositing unit 10 is disposed on an upper surface of the coin handling unit 2. The coin handling unit 2 has a cover 2*a* on a right side surface thereof. A cassette 30 (see FIG. 2) is mounted/dismounted with the cover 2*a* being opened, which will be described later in detail. The left side in FIG. 2 and FIGS. 7 to 12 is the front side of the coin handling unit 2.

The operation/display unit 3 functions as an operation unit for inputting information on money handling. The operation/display unit 3 also functions as a display unit for displaying information on the money handling. The money handling includes depositing, dispensing, collection, and replenishment of coins. For example, a touch panel type liquid crystal display device is used as the operation/display unit 3. The operation/display unit 3 need not be disposed independently from the coin handling unit 2, and may be built in the coin handling unit 2. The operation unit and the display unit of the operation/display unit 3 need not be integrated with each other as shown in FIG. 1, and may be implemented as independent units.

Figure 2:
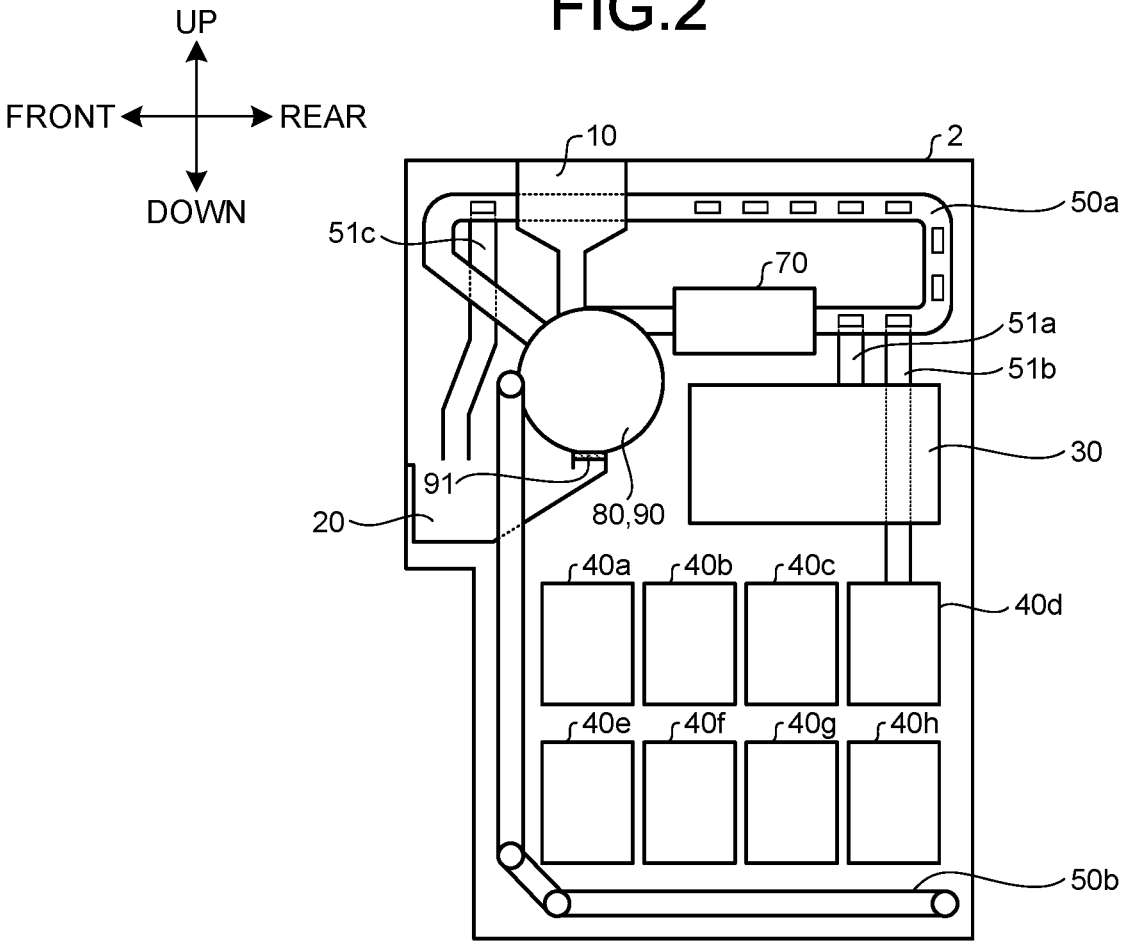
FIG. 2 schematically shows an internal structure of the coin handling unit.

FIG. 2 schematically shows an internal structure of the coin handling unit 2. The coin handling unit 2 includes the depositing unit 10, the dispensing unit 20, the cassette 30, storage units 40 (40*a* to 40*h*), transport units 50 (50*a*, 50*b*), chutes 51 (51*a* to 51*c*), a recognition unit 70, a feeding unit 80, a temporary storage unit 90, and a gate 91.

The storage units 40 and the feeding unit 80 perform storage of a plurality of numbers of coins and feeding of the stored coins. Each of the storage units 40 and the feeding unit 80 has a rotary disk, and feeds out the coins one by one with the rotary disk that rotates while being inclined. Specifically, the rotary disk has a plurality of projecting members on a radially outer area thereof, and the projecting members catch and feed out the coins one by one. Since the coin feeding method using the rotary disk is a conventional technique, detailed description thereof is omitted.

In depositing, the depositing unit 10 receives coins to be deposited. The coins are inserted into the depositing unit 10 from an opening disposed on the upper surface of the coin handling unit 2. The coins received by the depositing unit 10 are dropped into the feeding unit 80. The feeding unit 80 stores the dropped coins, and feeds out the stored coins one by one to a transport path (first transport path) that is a component of the transport unit 50*a*. The transport unit 50*a* transports, along the transport path, the coins fed by the feeding unit 80. The recognition unit 70 recognizes and counts the coins being transported along the transport path. The recognition unit 70 recognizes, for example, denomination, authenticity, and fitness of each coin, and counts the number and the monetary amount of coins for each denomination, and the total number and the total monetary amount of coins. The destination of each coin is determined based on the recognition result obtained by the recognition unit 70.

A plurality of chutes 51 are connected to the transport path. The chutes 51 are connected to the transport path downstream of the recognition unit 70 in the transport direction. A chute 51*a* connects the transport path to the cassette 30. A plurality of chutes 51*b* connect the transport path to the respective storage units 40 in a one to one correspondence. In FIG. 2, FIG. 4, and FIGS. 7 to 12, only some chutes 51*b* are shown to avoid complexity. A chute 51*c* connects the transport path to the dispensing unit 20. The openings of the chutes 51 formed in the transport path are normally closed by gates. Coins being transported along the transport path pass over the closed gates. When the gate of a chute 51 corresponding to the destination of a coin is opened, the coin is dropped into the chute 51 through the opening in the transport path. Through the chute 51, the dropped coin is sent to any of the dispensing unit 20, the cassette 30, and the storage units 40. For example, in depositing, coins that cannot be deposited are returned to the dispensing unit 20 as reject coins. Meanwhile, coins that can be deposited are stored in the coin storage units 40*a* to 40*h* for each denomination.

The kinds of coins to be stored in the respective storage units 40*a* to 40*h* can be set in advance. A single kind of coin or a plurality of kinds of coins can be stored in one storage unit 40. For example, the kind of coin to be stored is set by designating at least one of denomination, authenticity.

In depositing, each storage unit 40 stores deposited coins therein. In dispensing, each storage unit 40 feeds out stored coins to be dispensed one by one. A transport unit 50*b* including a transport path. (second transport path) is disposed beneath the storage units 40. Coins fed out from the storage units 40 are dropped on the transport path of the transport unit 50*b*. The transport path of the transport unit 50*b* is disposed so as to receive all the coins fed out from the storage units 40*a* to 40*h*, and transport the received coins to the feeding unit 80.

An openable/closable gate 91 is disposed on a bottom surface of the feeding unit 80. The gate 91 that separates the feeding unit 80 from the dispensing unit 20 is normally closed. In depositing, when a foreign object enters the feeding unit 80, the gate 91 is opened and the foreign object is discharged into the dispensing unit 20. For example, in depositing, a foreign object other than coins sometimes drops into the feeding unit 80 from the depositing unit 10, and remains at the bottom of the feeding unit 80 without being fed out by the rotary disk. In this case, the gate 91 is opened, and the dropped foreign object is returned from the dispensing unit 20. Opening/closing of the gate 91 in dispensing will be described later.

The transport unit 50*b* transports a coin, which has been received in the transport path beneath the storage units 40, toward the front side of the apparatus 1 (left side in FIG. 2) and thereafter transports the coin upward. The coin transported upward is dropped into the feeding unit 80. The coin dropped into the feeding unit 80 is handled in a dispensing mode that is selected from among a plurality of kinds of dispensing modes, and is discharged to the dispensing unit 20. The coin discharged to the dispensing unit 20 can be taken out from an opening of the dispensing unit 20 disposed on the front surface of the coin handling unit 2. The "dispensing mode" defines the content of coin handling to be performed in the coin handling unit 2 when dispensing is performed. Even when the same coin is dispensed, if the dispensing mode differs, the content of coin handling to be performed in the coin handling unit 2 differs. The kinds of dispensing modes and the contents of coin handling in the respective dispensing modes will be described later.

The cassette 30 is detachably mounted to the coin handling unit 2. The cassette 30 is disposed beneath the recognition unit 70 and above the storage units 40. Specifically, the cassette 30 is disposed at a position lower than the transport unit 50*a* that transports coins recognized by the recognition unit 70 and higher than all the storage units 40*a* to 40*h*. The cassette 30 performs storage of coins that the transport unit 50*a* has dropped into the chute 51*a*, and feeding of the coins. The coins fed out from the cassette 30 are dropped on the transport path of the transport unit 50*b*, like the coins fed out from the storage units 40. The cassette 30 is used for, for example, collection and replenishment of coins, which will be described later in detail.

In dispensing, the temporary storage unit 90 temporarily stores coins to be dispensed. The aforementioned feeding unit 80 also functions as the temporary storage unit 90. In other words, one component functions as both the feeding unit 80 and the temporary storage unit 90. The temporary storage unit 90 temporarily stores coins transported by the transport unit 50*b*. The temporary storage unit 90 opens the gate 91 and discharges the temporarily stored coins to the dispensing unit 20.

Figure 3:
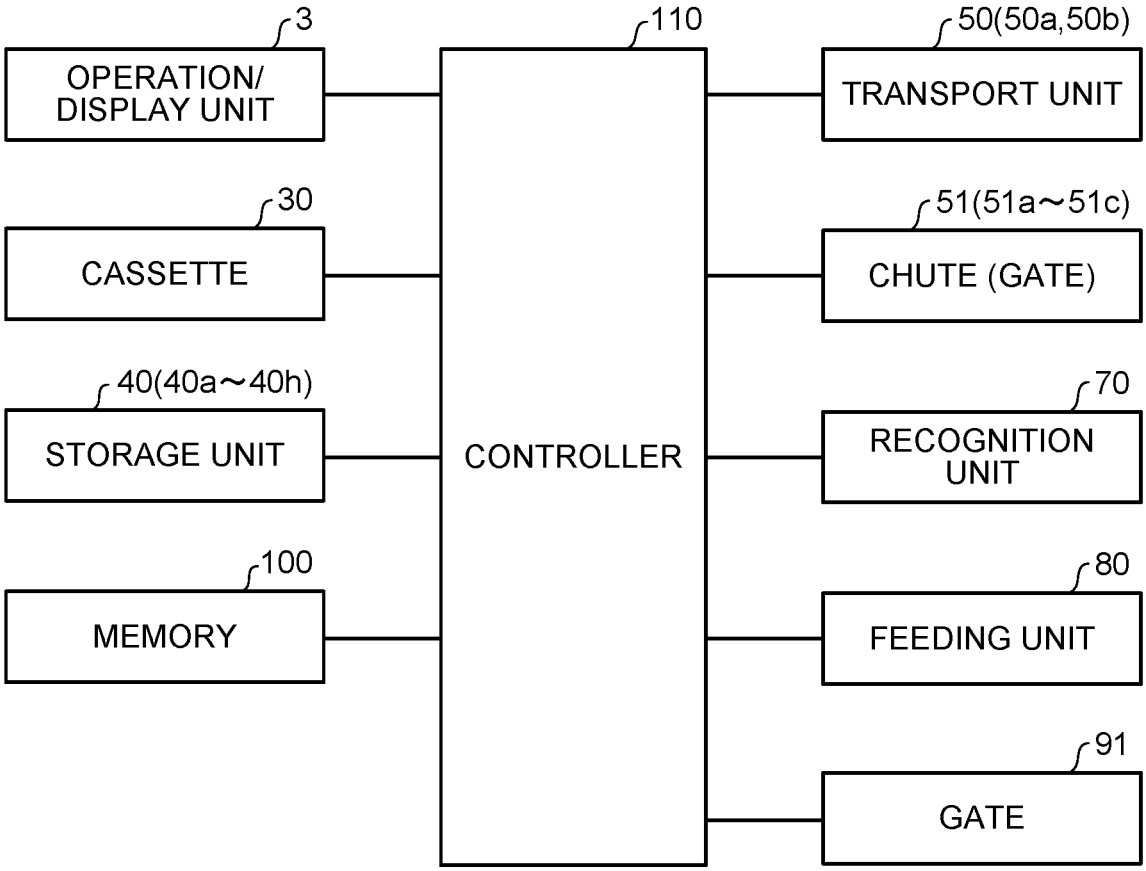
FIG. 3 is a block diagram schematically showing a functional structure of the coin handling unit.

FIG. 3 is a block diagram schematically showing the functional structure of the coin handling unit 2. The coin handling unit 2 includes a memory 100 and a controller 110, in addition to the components shown in FIG. 2. The memory 100 is a nonvolatile storage device. The memory 100 stores therein information on money handling. For example, the memory 100 stores therein information on the kinds of money handling to be performed by the coin handling unit 2, and setting information required for performing the respective kinds of money handling.

The controller 110 performs money handling while controlling the functions and operations of the respective components shown in FIG. 3. The controller 110 receives information inputted through the operation/display unit 3, and outputs and displays information on the operation/display unit 3. The controller 110 controls the respective components, based on an operation performed by using the operation/display unit 3, while referring to the various kinds of information stored in the memory 100, whereby the functions and operations of the coin handling apparatus 1 described in the present embodiment are implemented.

Figure 4A:
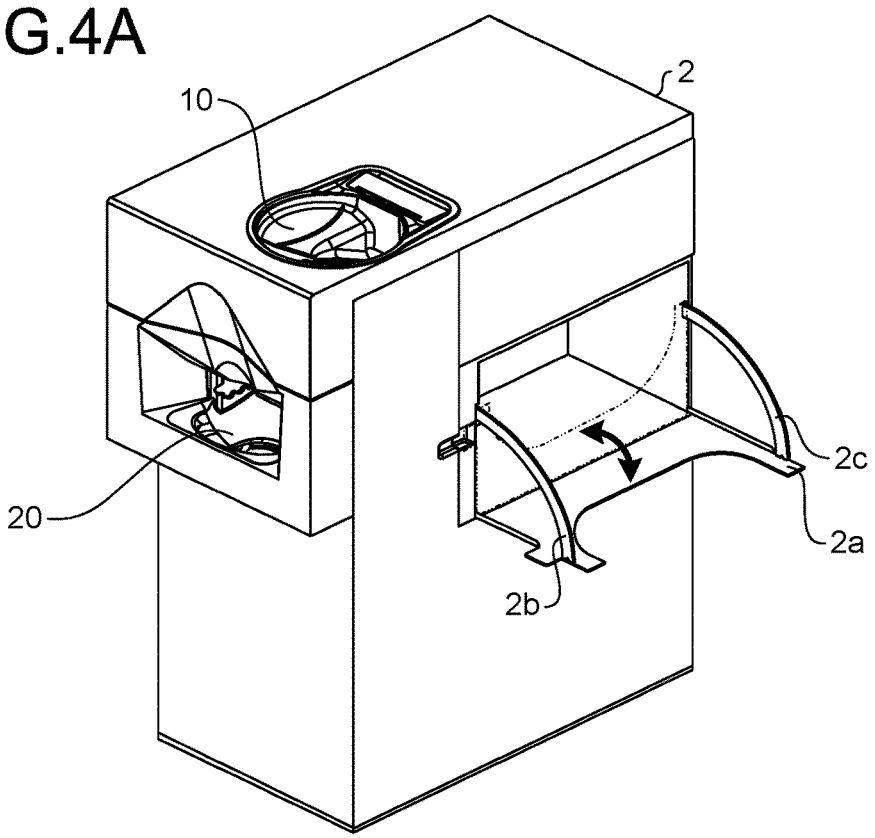
FIGS. 4A and 4B illustrate a cassette mounting/dismounting method.

Next, mounting/dismounting of the cassette 30 will be described with reference to FIGS. 4A and 4B. When a side surface, of the coin handling unit 2, on which the dispensing unit 20 is disposed is regarded as a front surface, the cover 2*a* is disposed on a right side surface as viewed from the front surface.

The cover 2*a* is pivotably connected to the side surface of the coin handling unit 2 by hinges (not shown). The cover 2*a* is pivotable about 90° between an opened position indicated by a solid line and a closed position indicated by a two-dot chain line, as shown by an arrow in FIG. 4A. When the cover 2*a* is in the closed position, the outer surface of the cover 2*a* is substantially flush with the right side surface of the coin handling unit 2. When the cover 2*a* has pivoted about 90° from the closed position to be in the opened position, an upper surface of the cover 2*a* becomes substantially horizontal. As shown in FIG. 4A, in the opened position, two arms 2*b*, 2*c* support the cover 2*a*. One ends of the arms 2*b*, 2*c* are fixed to a front-side right corner and a rear-side right corner of the cover 2*a* in the opened position. The other ends of the arms 2*b*, 2*c* are engaged with the coin handling unit 2 when the cover 2*a* is in the opened position. When the cover 2*a* is in the closed position, the arms 2*b*, 2*c* are housed inside the coin handling unit 2.

Inside the coin handling unit 2, electromagnetic lock mechanism is disposed corresponding to the arms 2*b*, 2*c*. Normally, the arms 2*b*, 2*c* inside the coin handling unit 2 are locked by the electromagnetic lock mechanism when the cover 2*a* is in the closed position, and the cover 2*a* cannot be opened. For example, the arms 2*b*, 2*c* are unlocked when a predetermined operation is performed by using the operation/display unit 3, whereby the cover 2*a* can be opened. After the cassette 30 is mounted/dismounted with the cover 2*a* being in the opened position, the cover 2*a* is closed and restored to the closed position, whereby the electromagnetic lock mechanism automatically lock the arms 2*b*, 2*c*. Inside the coin handling unit 2, a sensor for detecting the cassette 30 is disposed. Based on the detection result of the sensor and the locking state due to the electromagnetic lock mechanism, the coin handling unit 2 can detect that the cassette 30 is set at a predetermined position in the coin handling unit 2 and the cover 2*a* is closed.

The cassette 30 is mounted/dismounted by using a mounting unit formed in the coin handling unit 2. When the cover 2*a* is opened to be in the opened position, the opening formed on the side surface of the coin handling unit 2 is opened, and the mounting unit is exposed from the opening. When the cassette 30 inside the unit 2 is drawn out from the opening, the cassette 30 is dismounted from the mounting unit. When the cassette 30 is pushed into the unit 2 from the opening, the cassette 30 is mounted on the mounting unit. After the cassette 30 is mounted, the cover 2*a* is closed to be in the closed position, whereby the opening is closed.

Figure 4B:
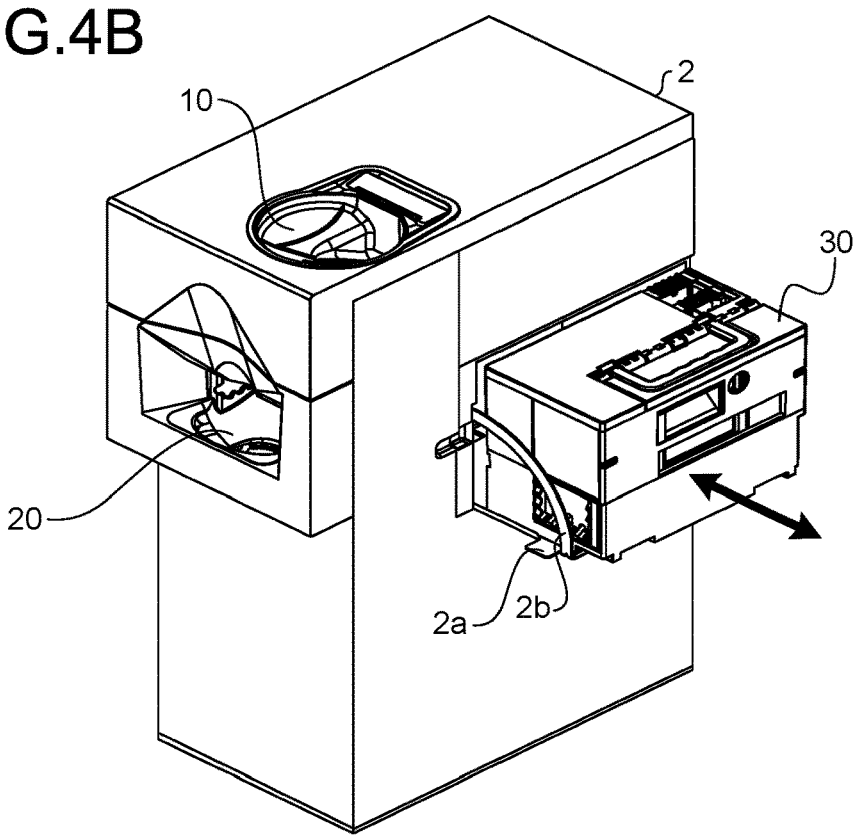

When the cassette 30 is mounted/dismounted, as shown in FIG. 4B, the cover 2*a* in the opened position functions as a placement table for the cassette 30. On the upper surface of the cover 2*a* in the opened position, guides for regulating the position and movement of the cassette 30 are disposed at opposed outer positions in the front-rear direction.

An operator, who performs mounting work of the cassette 30, places the cassette 30 between the opposed outer guides on the upper surface of the cover 2*a* in the opened position. The operator pushes the cassette 30 into the coin handling unit 2 while sliding the cassette 30 on the cover 2*a* along the guides. The pushed cassette 30 is mounted on the mounting unit. After pushing the cassette 30 into the coin handling unit 2, the operator closes the cover 2*a* to end the mounting work.

An operator, who performs dismounting work of the cassette 30, draws out the cassette 30 while sliding the cassette 30 on the cover 2*a* between the opposed outer guides on the upper surface of the cover 2*a* in the opened position. The drawn cassette 30 is dismounted from the mounting unit. The operator collects the cassette 30 drawn onto the cover 2*a*. The operator mounts another cassette 30 and closes the cover 2*a*.

As described above, the operator places the cassette 30 on the opened cover 2*a*, and slides the cassette 30 on the cover 2*a* to mount/dismount the cassette 30 to/from the coin handling unit 2. Even when a large number of coins are stored in the cassette 30, the operator can perform the work at a height that allows the operator to easily apply force to the cassette 30, thereby facilitating the mounting/dismounting work of the cassette 30.

Figure 5:
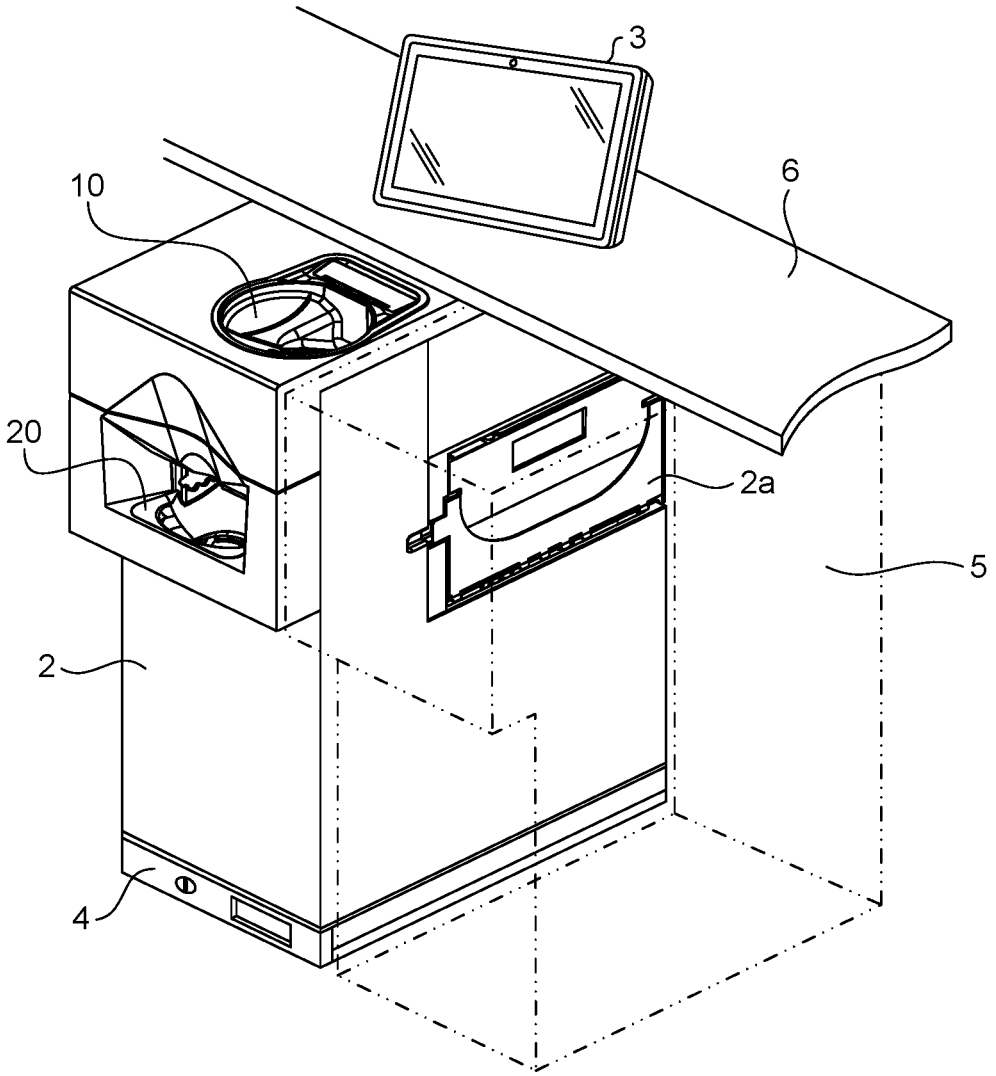
FIG. 5 shows an example of installation of the coin handling apparatus.

The cassette 30 is mounted/dismounted by using the opening at the side surface of the coin handling unit 2. Therefore, depending on the installation state of the coin handling unit 2, mounting/dismounting of the cassette 30 sometimes becomes difficult. FIG. 5 shows an example of installation of the coin handling apparatus 1. For example, as shown in FIG. 5, the coin handling apparatus 1 is used with the coin handling unit 2 being placed under a counter 6, and the operation/display unit 3 being placed on the counter 6. As shown by a two-dot chain line in FIG. 5, if another apparatus 5 is installed beside the coin handling unit 2 to the right, the cassette 30 cannot be mounted/dismounted with the cover 2*a* being opened. In order to cope with such a case, the coin handling apparatus 1 may be provided with a pedestal 4 at the bottom of the coin handling unit 2 as shown in FIG. 5. The pedestal 4 has a function that allows the coin handling unit 2 to move frontward and/or rearward. When the coin handling unit 2 is moved frontward or rearward to a position where the cover 2*a* can be opened, the mounting/dismounting work of the cassette 30 can be performed.

Figure 6A:
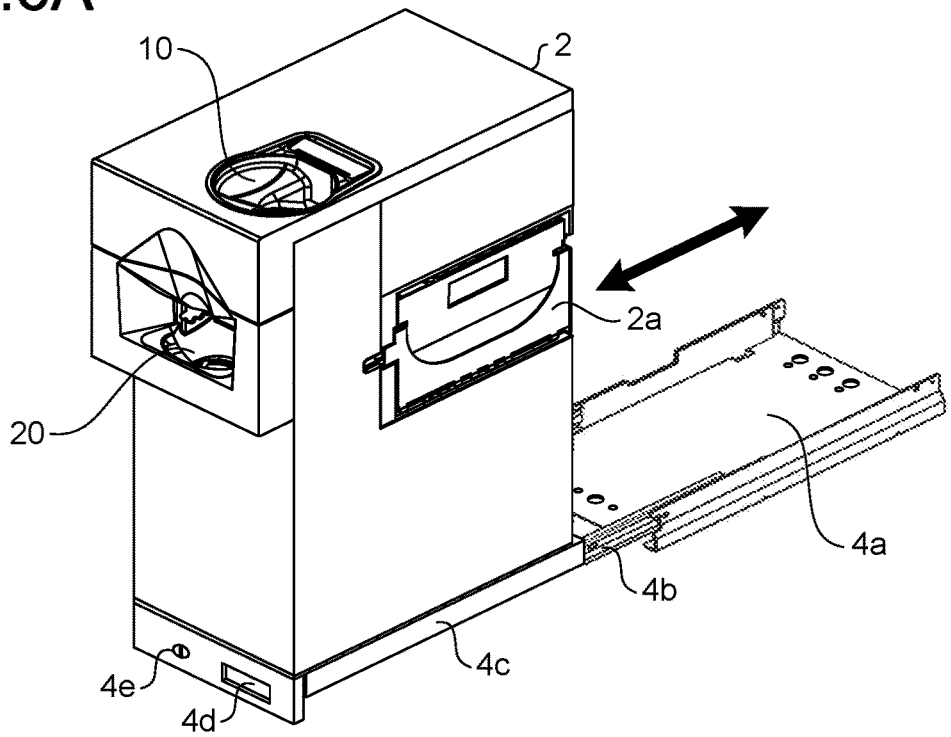
FIGS. 6A and 6B illustrate movement of a coin handling unit.
Figure 6B:
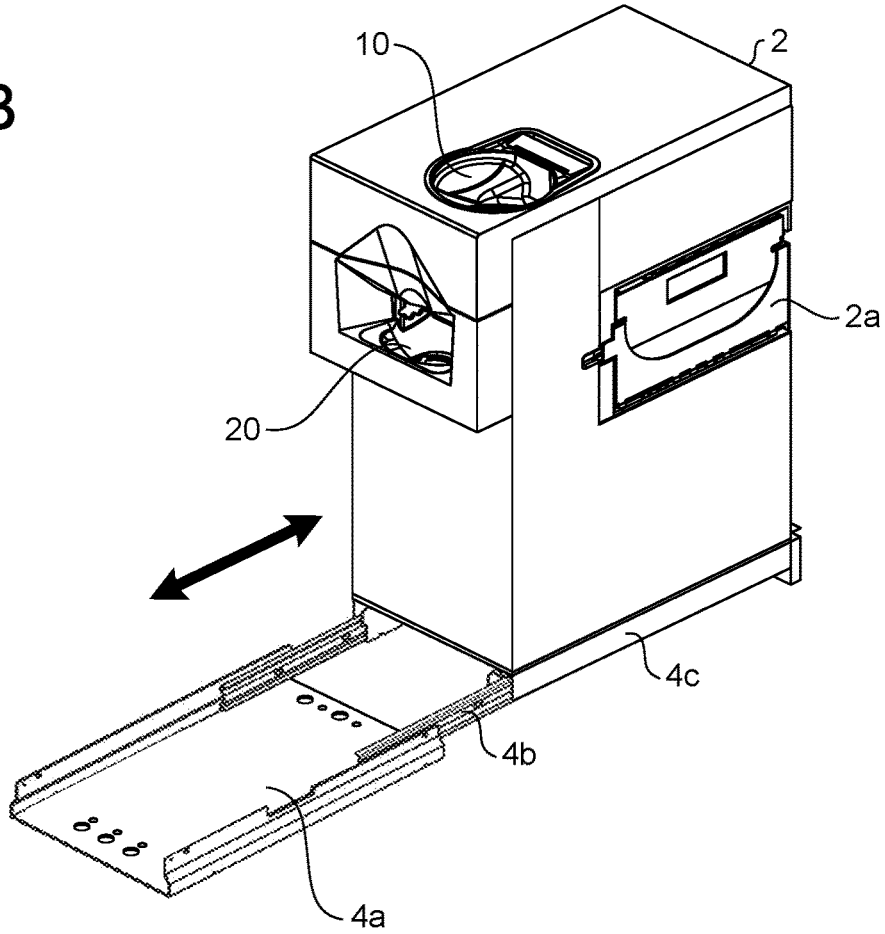

FIGS. 6A and 6B illustrate movement of the coin handling unit 2. The pedestal 4 includes a fixed part 4*a*, inner rails 4*b*, an outer rail 4*c*, a handle 4*d*, and a lock unit 4*e*. The part 4*a* is fixed to the place where the coin handling unit 2 is installed. In the example of FIG. 5, the part 4*a* is fixed to a floor surface under the counter 6. The outer rail 4*c* is fixed to a bottom surface of the coin handling unit 2. The inner rails 4*b* connect the fixed part 4*a* to the outer rail 4*c* so that the outer rail 4*c* is slidably moved with respect to the fixed part 4*a*. That is, the inner rails 4*b* and the outer rail 4*c* function as a slide rail that makes the coin handling unit 2 slidable with respect to the fixed part 4*a*. Thus, the coin handling unit 2 can be drawn frontward or rearward from the position of the fixed part 4*a*.

The outer rail 4*c* is provided with the handle 4*d* and the lock unit 4*e* on a side toward which the coin handling unit 2 is drawn. Usually, the coin handling unit 2 is used while being fixedly located on the fixed part 4*a*, as shown in FIG. 5. Fixing of the coin handling unit 2 is performed when the lock unit 4*e* locks the outer rail 4*c* to the fixed part 4*a*. The locked outer rail 4*c* cannot be drawn out from the fixed part 4*a*. When locking by the lock unit 4*e* is released, the outer rail 4*c* becomes drawable from the fixed part 4*a*. When the outer rail 4*c* is drawn out from the fixed part 4*a* by using the handle 4*d*, the coin handling unit 2 fixed to the outer rail 4*c* is drawn out.

Fixing the coin handling unit 2 to the outer rail 4*c* may be performed by a method shown in FIG. 6A or a method shown in FIG. 6B. The coin handling unit 2 can be fixed to the outer rail 4*c* with the handle 4*d* being on the front surface side as shown in FIG. 6A. In this case, the coin handling unit 2 can be drawn frontward with respect to the fixed part 4*a*.

The coin handling unit 2 can also be fixed to the outer rail 4*c* with the handle 4*d* being on the rear surface side as shown in FIG. 6B. In this case, the coin handling unit 2 can be drawn rearward with respect to the fixed part 4*a*.

Although the coin handling unit 2 is moved either frontward or rearward in the above examples, the coin handling unit 2 may be movable both frontward and rearward. In this case, the handle 4*d* and the lock unit 4*e* are disposed on each of the front surface side and the rear surface side of the coin handling unit 2. Thus, when drawing the coin handling unit 2 frontward, the operator releases locking by operating the lock unit 4*e* on the front surface side, and draws the unit 2 toward him/her while holding the handle 4*d*. When drawing the coin handling unit 2 rearward, the operator releases the locking by operating the lock unit 4*e* on the rear surface side, and draws the unit 2 toward him/her while holding the handle 4*d*.

Figure 7A:
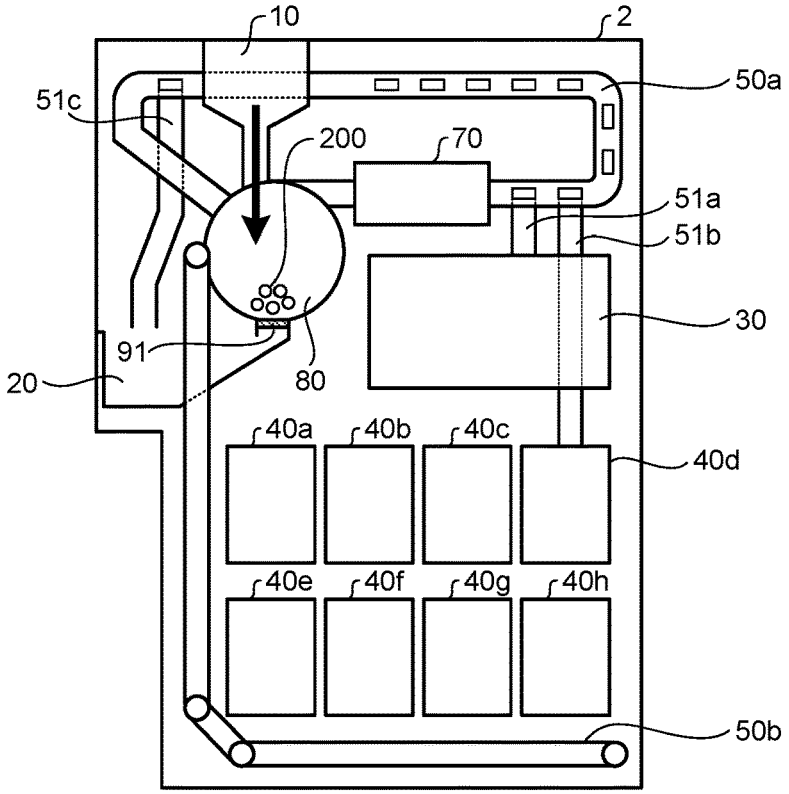
FIGS. 7A and 7B schematically illustrate depositing.
Figure 7B:
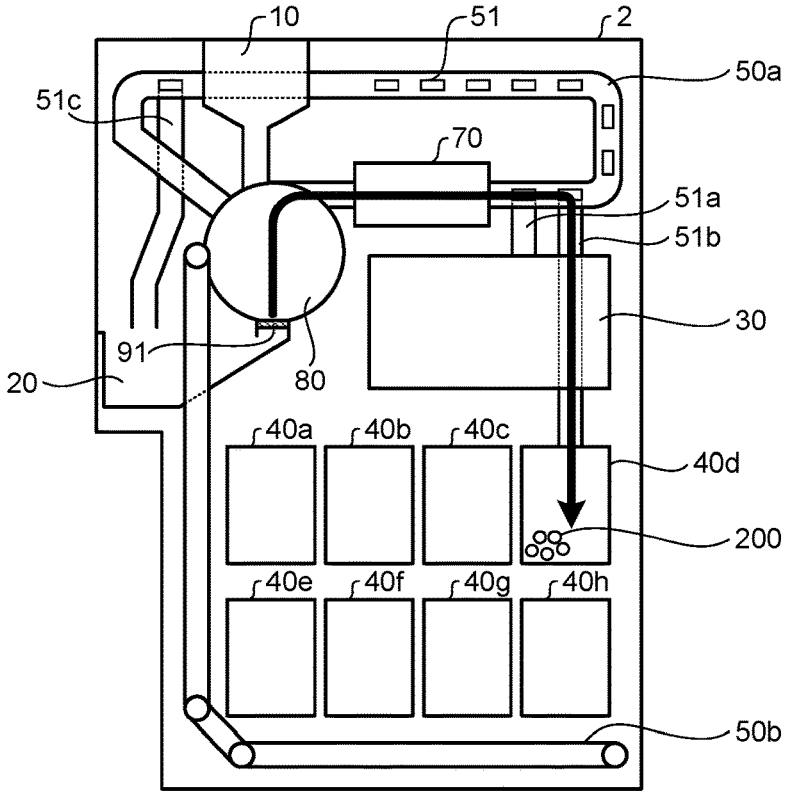

Next, coin handling performed by the coin handling apparatus 1 will be described. FIGS. 7A and 7B schematically illustrate depositing. As shown in FIG. 7A, coins 200 inserted in the depositing unit 10 are dropped into the feeding unit 80. The feeding unit 80 can store a large number of coins 200. As shown in FIG. 7B, the coins fed out from the feeding unit 80 are transported one by one along the transport path by the transport unit 50*a*. The coins being transported along the transport path are recognized and counted by the recognition unit 70, and thereafter are dropped through the chutes 51 and stored in the storage units 40. While FIG. 7B shows an example where the coins 200 are stored in the storage unit 40*d*, destination of each coin is selected from among the cassette 30 and the storage units 40*a* to 40*h*. For example, the coins are stored in the plurality of storage units 40*a* to 40*h* for each denomination. The coins having been stored in the storage units 40 in depositing can be fed out from the storage units 40 and discharged to the dispensing unit 20 in dispensing.

Figure 8:
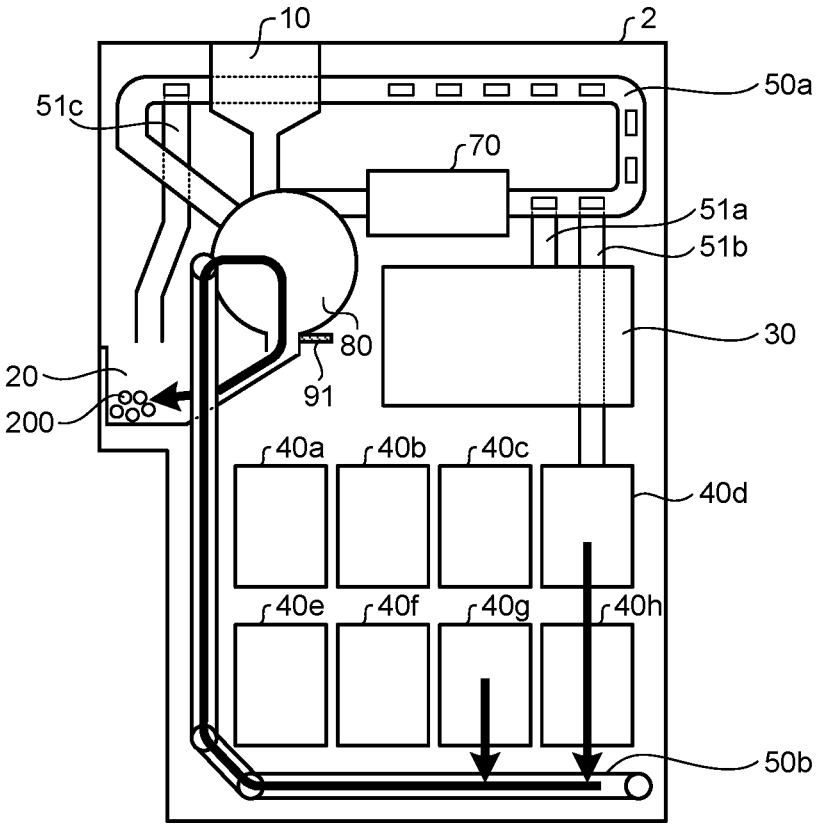
FIG. 8 schematically illustrates direct dispensing in a first mode.

The coin handling apparatus 1 performs three types of dispensing, i.e., a first mode, a second mode, and a third mode, having different handling contents. When the first mode is selected, the coin handling apparatus 1 performs direct dispensing. In the direct dispensing, coins to be dispensed are not subjected to recognition by the recognition unit 70 and temporary storage by the temporary storage unit 90. FIG. 8 schematically illustrates the direct dispensing in the first mode. As shown in FIG. 8, coins to be dispensed are fed out from the storage units 40 and dropped on the transport path of the transport unit 50*b*. The transport unit 50*b* sequentially transports the coins received on the transport path to the feeding unit 80. In the first mode, the gate 91 at the bottom surface of the feeding unit 80 is being opened. Therefore, the coins dropped into the feeding unit 80 are not stored in the feeding unit 80 but are dropped into the dispensing unit 20. The coins transported by the transport unit 50*b* are sequentially dropped into the dispensing unit 20. Thus, coins 200 are dispensed from the dispensing unit 20.

When the second mode is selected, the coin handling apparatus 1 performs temporary-storing dispensing. In the temporary-storing dispensing, coins to be dispensed are subjected to temporary storage by the temporary storage unit 90, but are not subjected to recognition by the recognition unit 70. In the second mode, the feeding unit 80 functions as the temporary storage unit 90. Since feeding of coins is not performed when the feeding unit 80 functions as the temporary storage unit 90, the rotary disk is not rotated.

Figure 9A:
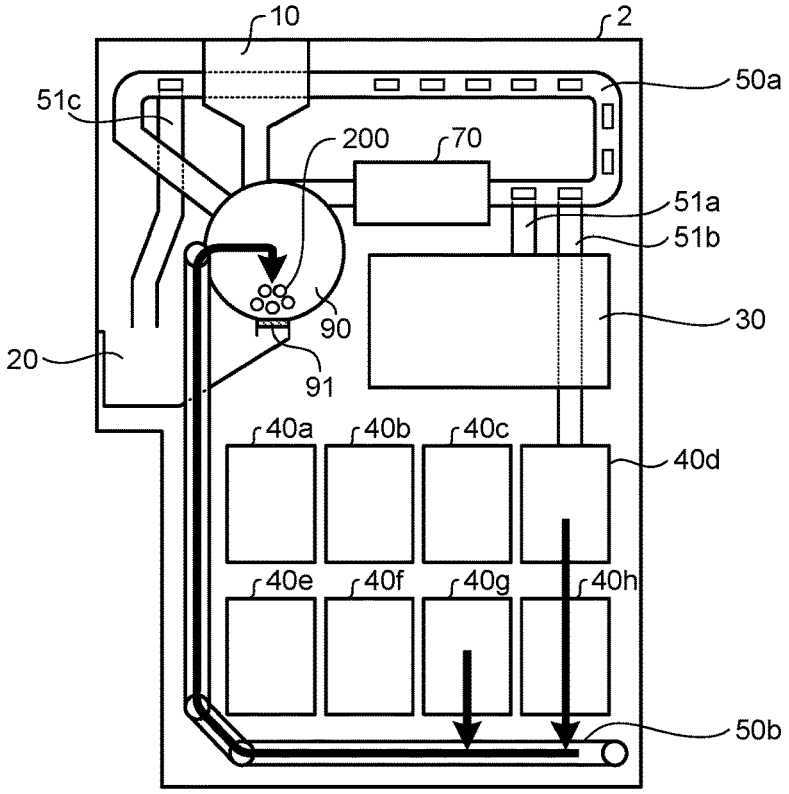
FIGS. 9A and 9B schematically illustrate temporary-storing dispensing in a second mode.
Figure 9B:
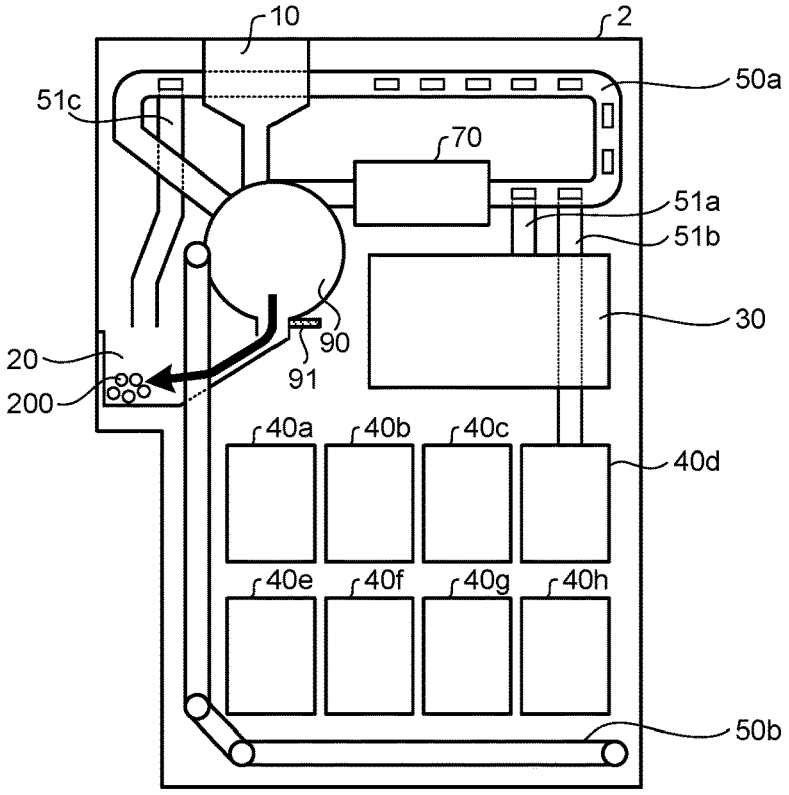

FIGS. 9A and 9B schematically illustrate the temporary-storing dispensing in the second mode. As shown in FIG. 9A, coins to be dispensed are fed out from the storage units 40 and dropped on the transport path of the transport unit 50*b*. The transport unit 50*b* sequentially transports the coins received on the transport path to the temporary storage unit 90. In the second mode, the gate 91 at the bottom surface of the temporary storage unit 90 is closed. The temporary storage unit 90 performs temporary storage for temporarily storing coins 200 received from the transport unit 50*b*. After all the coins to be dispensed are stored in the temporary storage unit 90, the gate 91 is opened as shown in FIG. 9B, and the coins 200 are dropped into the dispensing unit 20. Thus, all the coins 200 temporarily stored in the temporary storage unit 90 are dispensed from the dispensing unit 20 almost simultaneously.

When the third mode is selected, the coin handling apparatus 1 performs reconciliation dispensing. In the reconciliation dispensing, coins to be dispensed are subjected to recognition by the recognition unit 70 but are not subjected to temporary storage by the temporary storage unit 90. In the third mode, the feeding unit 80 performs feeding of coins without performing temporary storage. Therefore, after the reconciliation dispensing has started, the feeding unit 80 rotates the rotary disk to start feeding of coins.

Figure 10A:
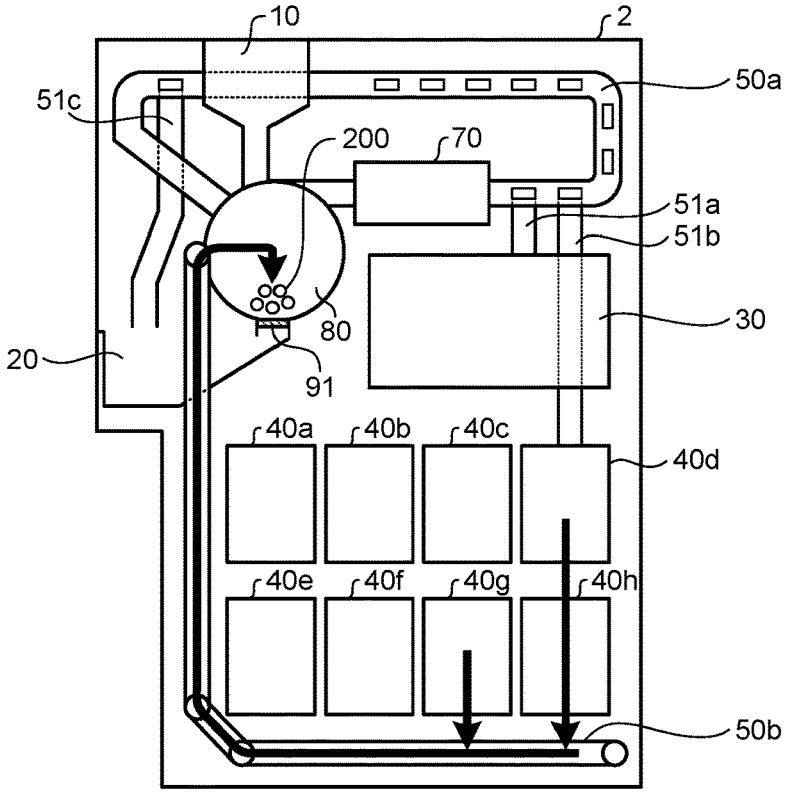
FIGS. 10A and 10B schematically illustrate reconciliation dispensing in a third mode.
Figure 10B:
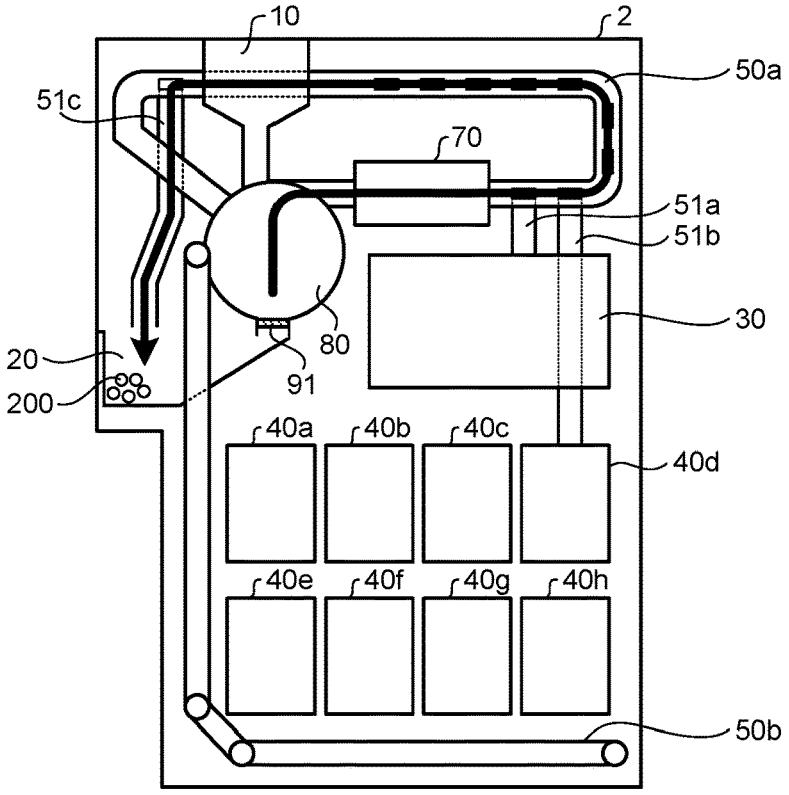

FIGS. 10A and 10B schematically illustrate the reconciliation dispensing in the third mode. As shown in FIG. 10A, coins to be dispensed are fed out from the storage units 40 and dropped on the transport path of the transport unit 50*b*. The transport unit 50*b* sequentially transports the coins received on the transport path to the feeding unit 80. In the third mode, the gate 91 at the bottom surface of the feeding unit 80 is closed. Therefore, coins 200 are accumulated in the feeding unit 80. The feeding unit 80 receives the coins from the transport unit 50*b* and stores the received coins therein, and feeds out the stored coins one by one to the transport path of the transport unit 50*a*.

As shown in FIG. 10B, the coins in the feeding unit 80 are fed out to the transport path of the transport unit 50*a*. The fed out coins are transported along the transport path by the transport unit 50*a*. The recognition unit 70 recognizes the coins being transported along the transport path. The coins recognized and counted by the recognition unit 70 are dropped through the chute 51*c*, and sent to the dispensing unit 20. Thus, the coins 200 are dispensed one by one from the dispensing unit 20.

Figure 11A:
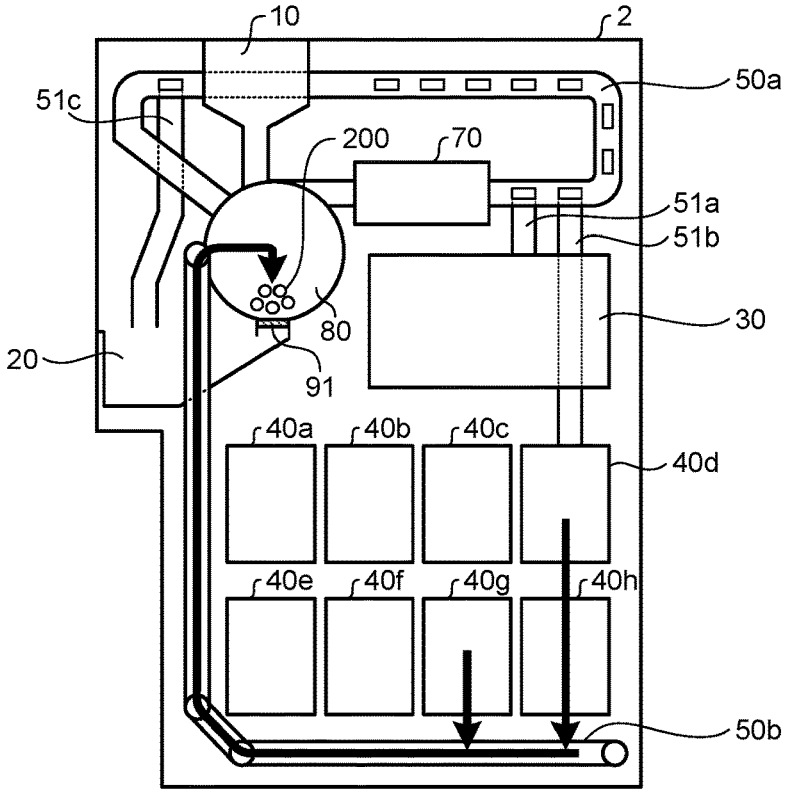
FIGS. 11A and 11B schematically illustrate collection of coins.
Figure 11B:
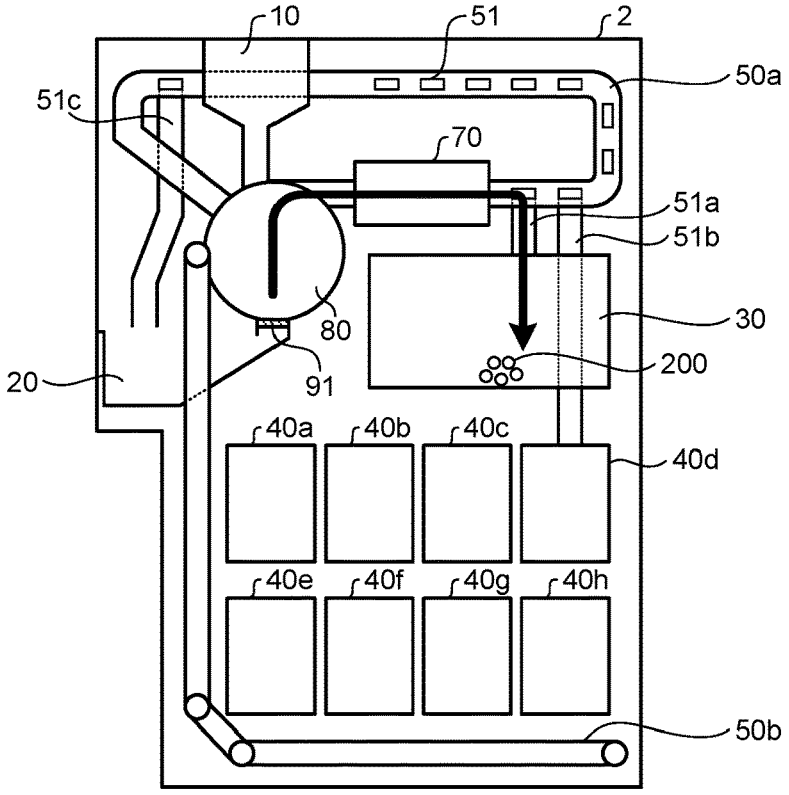

Collection of coins from the coin handling unit 2 can be performed using the cassette 30. FIGS. 11A and 11B schematically illustrate collection of coins. As shown in FIG. 11A, coins to be collected from the coin handling unit 2 are fed out from the storage units 40 and dropped on the transport path of the transport unit 50*b*. The transport unit 50*b* transports the coins received on the transport path to the feeding unit 80. At this time, the gate 91 at the bottom surface of the feeding unit 80 is closed. Therefore, coins 200 are accumulated in the feeding unit 80. The feeding unit 80 receives the coins from the transport unit 50*b* and stores the received coins therein, and feeds out the stored coins one by one to the transport path of the transport unit 50*a*.

As shown in FIG. 11B, the coins in the feeding unit 80 are fed out to the transport path of the transport unit 50*a*. The fed out coins are transported one by one along the transport path by the transport unit 50*a*. The coins being transported along the transport path are recognized and counted by the recognition unit 70. The recognized and counted coins are dropped through the chute 51*a* connected to the transport path, and are stored into the cassette 30. The coins stored in the cassette 30 are collected together with the cassette 30 by dismounting the cassette 30 from the coin handling unit 2.

Figure 12A:
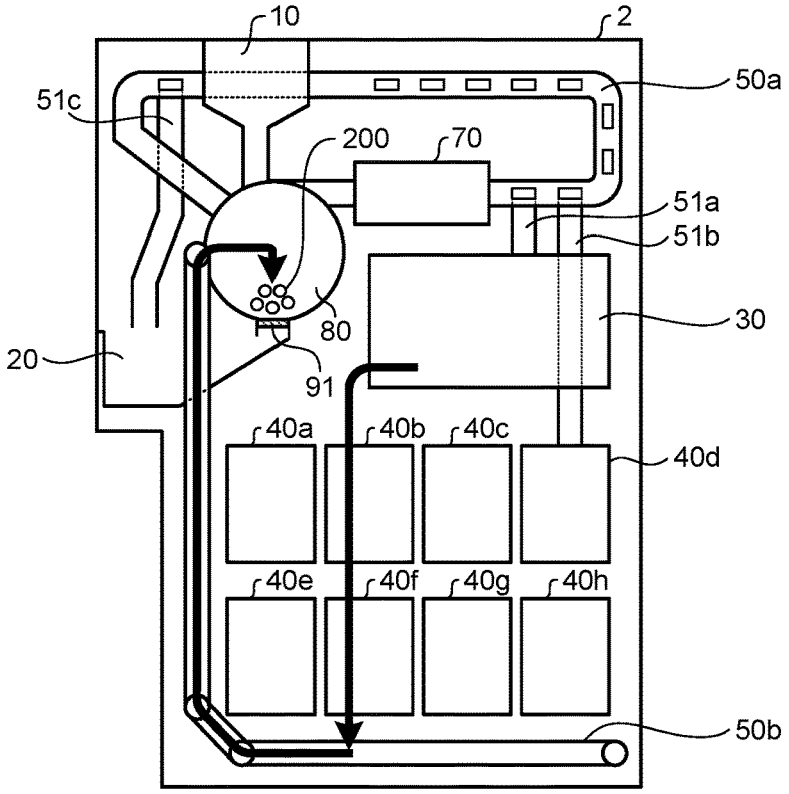
FIGS. 12A and 12B schematically illustrate replenishment of coins.
Figure 12B:
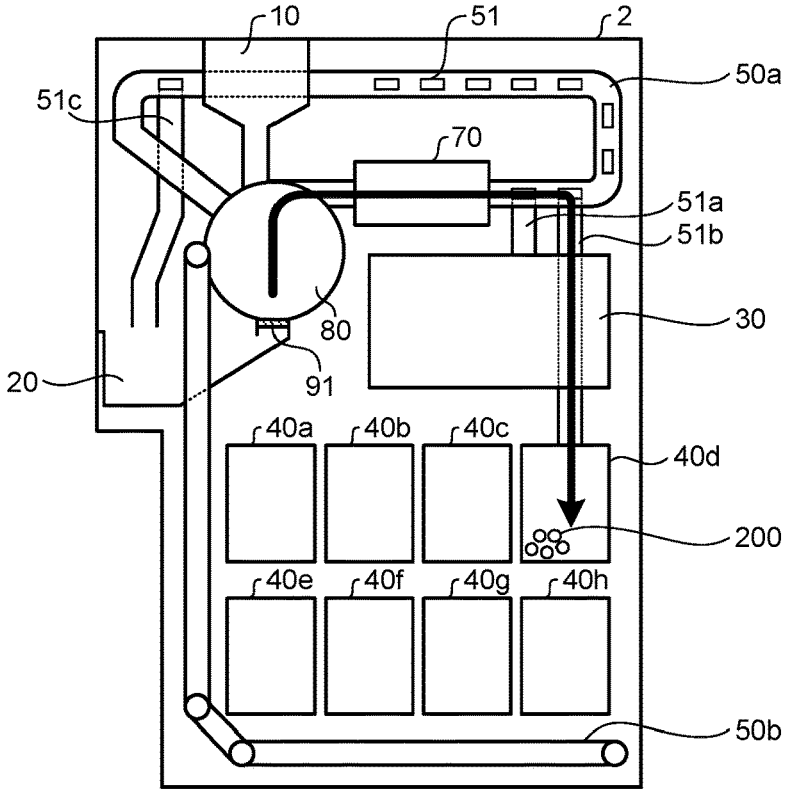

Replenishment of the coin handling unit 2 with coins can also be performed using the cassette 30. FIGS. 12A and 12B schematically illustrate the replenishment. Firstly, a cassette 30 in which coins for replenishment are stored is mounted to the coin handling unit 2. As shown in FIG. 12A, the coins for replenishment are fed out from the cassette 30 and dropped on the transport path of the transport unit 50*b*. The transport unit 50*b* transports the coins received on the transport path to the feeding unit 80. At this time, the gate 91 at the bottom surface of the feeding unit 80 is closed. Therefore, coins 200 are accumulated in the feeding unit 80. The feeding unit 80 receives the coins from the transport unit 50*b* and stores the received coins therein, and feeds out the stored coins one by one to the transport path of the transport unit 50*a*.

As shown in FIG. 12B, the coins in the feeding unit 80 are fed out to the transport path of the transport unit 50*a*. The fed out coins are transported one by one along the transport path by the transport unit 50*a*. The coins being transported along the transport path are recognized and counted by the recognition unit 70. The recognized and counted coins are dropped through the chute 51*b* connected to the transport path, and are stored in the storage unit 40. While FIG. 12B shows an example where the coins 200 are stored in the storage unit 40*d*, destination of each coin is selected from among the storage units 40*a* to 40*h*. For example, the coins are stored in the plurality of storage units 40*a* to 40*h* for each denomination.

The cassette 30 is disposed at a position lower than the recognition unit 70 so as to receive the coins that have been recognized by the recognition unit 70 and dropped by their own weights from the transport path of the transport unit 50*a*. The position where the cassette 30 is disposed is higher than the storage units 40 that receive the coins dropped by their own weights from the transport path of the transport unit 50*a*. For example, the cassette 30 is mounted/dismounted at a height of about 450 to 500 mm from the floor surface on which the coin handling unit 2 is installed. Therefore, when performing collection or replenishment of coins, the operator can mount/dismount the cassette 30 more easily than in the case where the cassette 30 is disposed beneath the storage unit 40. Transport of coins to be stored in the cassette 30 for collection and transport of coins fed out from the cassette 30 for replenishment are performed using the same transport path as the transport path used for depositing and dispensing. Therefore, the coin handling unit 2 need not be provided with a dedicated transport path for the cassette 30.

In the present embodiment, the cassette 30 is disposed above all the storage units 40*a* to 40*h*. However, the cassette 30 may be disposed above at least one storage unit. For example, the coin handling unit 2 may have a small-sized storage unit disposed above or at substantially the same height as the cassette 30.

In the present embodiment, the side surface, of the coin handling unit 2, on which the dispensing unit 20 is disposed is regarded as the front surface, and the cassette 30 is mounted/dismounted to/from the right side surface as viewed from the front surface. However, the cassette 30 may be mounted/dismounted to/from the left side surface as viewed from the front surface.

In the present embodiment, the coin handling apparatus 1 includes the coin handling unit 2 and the operation/display unit 3. However, the structure of the coin handling apparatus is not limited thereto. For example, the coin handling unit 2 may be a coin handling apparatus and the operation/display unit 3 may be an operation terminal. Alternatively, the coin handling unit 2 may include the operation/display unit 3 to function as a coin handling apparatus.

In the present embodiment, a coin handling apparatus includes: a first transport path in which coins are transported; a feeding unit configured to feed out the coins one by one to the first transport path; a recognition unit configured to recognize the coins that are fed out to the first transport path by the feeding unit; a storage unit disposed beneath the recognition unit, the storage unit being configured to receive the coins recognized by the recognition unit from the first transport path, and store the coins therein; and a cassette detachably disposed beneath the recognition unit and above the storage unit, the cassette being configured to receive the coins from the first transport path and store the coins therein.

In the above configuration, the coin handling apparatus includes a plurality of the storage units, and the cassette is disposed above all the storage units.

In the above configuration, the coin handling apparatus further includes a second transport path configured to receive coins fed out from the storage unit and coins fed out from the cassette, and transport the coins to the feeding unit.

In the above configuration, the cassette feeds out coins and drops the coins on the second transport path.

In the above configuration, the coin handling apparatus further includes a chute connecting the first transport path to the cassette, and coins dropped from the first transport path are stored in the cassette through the chute.

In the above configuration, the cassette is detachably disposed through an opening formed at a side surface of the coin handling apparatus.

In the above configuration, the coin handling apparatus further includes a cover that is pivotable between a closed position in which the opening is closed and an open position in which the opening is opened, and the cover in the open position serves as a placement table on which the cassette is placed when being mounted/dismounted.

In the above configuration, the cassette is mounted/dismounted while being moved on the cover in the open position.

In the above configuration, when collecting coins from the storage unit, coins fed out from the storage unit are transported to the feeding unit along the second transport path, and the coins fed out from the feeding unit are stored in the cassette through the first transport path. When replenishing the storage unit with coins, coins fed out from the cassette are transported to the feeding unit along the second transport path, and the coins fed out from the feeding unit are stored in the storage unit through the first transport path.

In the above configuration, the coin handling apparatus further includes: a part fixed to a floor surface; and a slide rail connecting the coin handling apparatus to the fixed part so that the coin handling apparatus can be moved from a fixed position of the fixed part.

In the above configuration, the coin handling apparatus is movable in at least one of a first direction and a second direction opposite to the first direction with respect to the fixed part.

As described above, the coin handling apparatus has the cassette that is detachably mounted to the apparatus, at a high position that is away in an upward direction from the bottom surface of the apparatus, i.e., the floor surface where the apparatus is installed. This allows the cassette to be easily mounted/dismounted. The cassette can be mounted/dismounted to/from the side surface of the coin handling apparatus. This allows the cassette mounting/dismounting work to be performed from the front surface side and the rear surface side of the coin handling apparatus.

The coin handling apparatus is installed so as to be drawable from at least either of the front surface side and the rear surface side. When the operator performs cassette mounting/dismounting from the front surface side, the operator can perform the work with the coin handling apparatus being drawn toward the front surface side. When the operator performs cassette mounting/dismounting from the rear surface side, the operator can perform the work with the coin handling apparatus being drawn toward the rear surface side.

The coin handling apparatus has the openable/closable cover at the opening on the side surface from where the cassette is mounted/dismounted. When mounting/dismounting the cassette, the operator can use the opened cover as a placement table for placing the cassette. The operator can mount/dismount the cassette to/from the coin handling apparatus while sliding the cassette over the cover. This enables the operator to easily mount/dismount the cassette even when the cassette contains a large number of coins.

As described above, the coin handling apparatus according to one aspect of the present invention is useful in providing a coin handling apparatus that can easily perform a cassette mounting/dismounting work.

What is claimed is:

1. A coin handling apparatus, comprising:

a first transport path configured to transport coins;

a feeding unit configured to feed out the coins one by one to the first transport path;

a recognition unit configured to recognize the coins fed out to the first transport path by the feeding unit;

a storage unit arranged beneath the recognition unit, the storage unit being configured to receive the coins recognized by the recognition unit from the first transport path, and store the coins therein;

a cassette detachably mounted to the coin handling apparatus and arranged beneath the recognition unit and above the storage unit, the cassette being configured to receive the coins from the first transport path and store the coins therein; and a second transport path configured to receive coins fed out from the storage unit and coins fed out from the cassette, and transport the coins forward toward a front side of the coin handling apparatus and thereafter transport the coins upward to the feeding unit, and a cover that is movable between a closed position in which an opening is closed and an opened position in which the opening is opened, wherein the cover in the opened position serves as a placement table on which the cassette is placed when the cassette is mounted to and discounted from the coin handling apparatus wherein the mounted cassette is arranged rearward from the feeding unit inside the coin handling apparatus.

2. The coin handling apparatus according to claim 1, comprising a plurality of the storage units, wherein the cassette is disposed above all the storage units.

3. The coin handling apparatus according to claim 1, wherein the cassette feeds out coins and drops the coin on a part, from which the coins are transported forward, of the second transport path.

4. The coin handling apparatus according to claim 1, further comprising a chute connecting the first transport path to the cassette, wherein coins dropped from the first transport path are stored in the cassette through the chute.

5. The coin handling apparatus according to claim 1, wherein when collecting coins from the storage unit, the coins fed out from the storage unit are transported to the feeding unit along the second transport path, and the coins fed out from the feeding unit are stored in the cassette through the first transport path, and when replenishing the storage unit with coins, the coins fed out from the cassette are transported to the feeding unit along the second transport path, and the coins fed out from the feeding unit are stored in the storage unit through the first transport path.

6. The coin handling apparatus according to claim 1, wherein four storage units are arranged in a horizontal direction and another four storage units are arranged above the four storage units.

7. The coin handling apparatus according to claim 1, further comprising a dispensing unit that dispenses the coin from the coin handling apparatus, wherein the dispensing unit is disposed on a front surface of the coin handling apparatus, and the opening for mounting/dismounting the cassette is formed on a right side surface or a left side surface different from the front surface.

8. A coin handling apparatus, comprising:

a first transport path configured to transport coins;

a feeding unit configured to feed out the coins one by one to the first transport path;

a recognition unit configured to recognize the coins fed out to the first transport path by the feeding unit;

a storage unit arranged beneath the recognition unit, the storage unit being configured to receive the coins recognized by the recognition unit from the first transport path, and store the coins therein;

a cassette detachably mounted to the coin handling apparatus and arranged beneath the recognition unit and above the storage unit, the cassette being configured to receive the coins from the first transport path and store the coins therein;

a cover that is pivotable between a closed position in which an opening is closed and an opened position in which the opening is open, wherein the cover in the opened position serves as a placement table on which the cassette is placed when being mounted/dismounted;

a fixed part fixed to a floor surface; and a slide rail connecting the coin handling apparatus to the fixed part so that the coin handling apparatus is movable with respect to the fixed part, wherein the cassette is detachably mounted to the coin handling apparatus through the opening formed on a right side surface or a leftside surface of the coin handling apparatus, and arranged rearward from the feeding unit inside the coin handling apparatus.

9. The coin handling apparatus according to claim 8, wherein the coin handling apparatus is movable in at least one of a first direction and a second direction opposite to the first direction with respect to the fixed part.

10. The coin handling apparatus according to claim 8, wherein when the cover is in the closed position, an outer surface of the over is flush with a surface of the coin handling apparatus, and when the cover is in the opened position, an upper surface of the cover is horizontal.

11. The coin handling apparatus according to claim 8, the cover is configured such that the cassette is slidable on the cover in the opened position when the cassette placed on the cover is moved to mount to and dismount from the coin handling apparatus.

12. The coin handling apparatus according to claim 8, wherein the cover includes a guide for regulating a position and movement of the cassette placed on the cover, and the cassette is mounted to and dismounted from the coin handling apparatus by moving along the guide.

13. The coin handling apparatus according to claim 8, further comprising:

a sensor that detects the cassette set at a predetermined position in the coin handling apparatus; and a lock mechanism that locks/unlocks the cover wherein the lock mechanism automatically locks the cover when the cover moves to the closed position from the opened position.

* * * * *